United States Patent [19]

Didion

[11] Patent Number: 5,016,827

[45] Date of Patent: May 21, 1991

[54] SAND RECLAIMING DRUM

[75] Inventor: Charles J. Didion, St. Charles County, Mo.

[73] Assignee: Didion Manufacturing Company, St. Peters, Mo.

[21] Appl. No.: 506,102

[22] Filed: Apr. 9, 1990

[51] Int. Cl.[5] ..... B02C 17/02

[52] U.S. Cl. ..... 241/79.3; 164/404; 241/299; 241/DIG. 10

[58] Field of Search ..... 164/404, 5; 241/DIG. 10, 79.3, 299, 182, 183, 74

[56] References Cited

U.S. PATENT DOCUMENTS

| | | | |
|---|---|---|---|
| 2,188,798 | 1/1940 | Smith | 241/DIG. 10 X |
| 4,154,290 | 5/1979 | Weststrate et al. | 164/404 |
| 4,674,691 | 6/1987 | Didion | 241/DIG. 10 X |

*Primary Examiner*—Mark Rosenbaum
*Attorney, Agent, or Firm*—Paul M. Denk

[57] ABSTRACT

A sand reclaiming drum incorporating a single cylinder, or structured having a dual cylinder reclaimer. The sand reclaiming drum comprises four sections: an inlet section into which mold castings are introduced, first and second inner sections, and an outlet section. The inlet and first inner sections include helical rifling which urge the castings forward. The first and second inner sections include plates which greatly agitate the castings to loosen embedded sand therefrom. The outlet section includes a plurality of perforations along its length through which the sand may exit the drum and ejection means to urge the sand free castings from the reclaimer.

6 Claims, 1 Drawing Sheet

SAND RECLAIMING DRUM

BACKGROUND OF THE INVENTION

This invention relates generally to a drum used as a shake-out unit or as a reclaiming apparatus for recovering mold sand used in the formation of a mold for the casting of iron or other metal parts, and in particular this apparatus relates to the removal of sand from such castings.

Various types of tumbling machines to remove mold sand form castings are well known in the heart and have been long available. My prior patent, U.S. Pat. No. 4,674,691, contains a comprehensive listing of prior art patents. In addition, my patent No. 3,998,262 shows an early embodiment for such developments.

Many of these earlier drums only have rifling which urge castings forward. Thus sand is removed only by the motion of the casting tumbling along the bottom of the drum. My prior above mentioned patent partially removed this problem by utilizing abrasive particles. These particles would also help remove the sand that is embedded on interior surfaces of the casting. Thus the sand on the interior of the casting did not have to be manually removed, a procedure which previously consumed many man hours of labor to perform.

SUMMARY OF THE INVENTION

One object of the present invention is to provide a device to remove and separate mold sand from castings and to reclaim the mold sand for further use.

Another object is to provide such a device which will efficiently remove sand from castings without the aid of abrasive particles, which may require manual removal when they get caught in the castings.

Another object is to provide such a device which will jar mold sand embedded in the casting loose from the casting, so that even hard to remove sand will be removed.

These and other objects will become apparent to those skilled in the art in light of the following disclosure and accompanying drawings.

In accordance with the object, generally stated, there is provided a rotary drum including an inlet section, an outlet section, a first inner section and a second inner section. The inlet section, into which castings are introduced, includes a plurality of helically arranged vanes, or perhaps rifling means, which will urge the castings forwardly that have been introduced into the drum and cause them to tumble through the section. The first inner section includes a plurality of vanes or rifling means, which are mounted an an angle of less pitch than that of the rifling means of the inlet section. It further includes a plurality of protruding plates which agitate the castings, causing the grains of sand which are embedded into surfaces, whether internally or externally, of the castings to come loose. The second inner section includes a plurality of plates, but no rifling means to urge the castings forwardly, thus, they spend more time in the second inner section than in the first. These plates may be slightly canted forwardly to help urge the castings and sand to move along the drum. The agitation together with the greater length of time spent in the second inner section cause mold sand to be effectively removed. Therefore the use of abrasive particles is not necessarily needed and a later step of removing abrasive particles caught within the casting is eliminated. Further, because the castings tumble around in the drum, most of the sand that may otherwise be trapped in the casting will fall out, thus the sand in the interior of the casting need not be removed manually. The outlet section includes perforations in the wall of the drum through which the mold sand exits the drum or to an outer cylinder, and ejection means may be provided at the end of the drum to urge the castings out of the drum. Thus the sand exists the drum separately from the castings, and under such conditions the sand is generally ready to be used again.

DESCRIPTION OF THE PREFERRED EMBODIMENT

Figure 1:
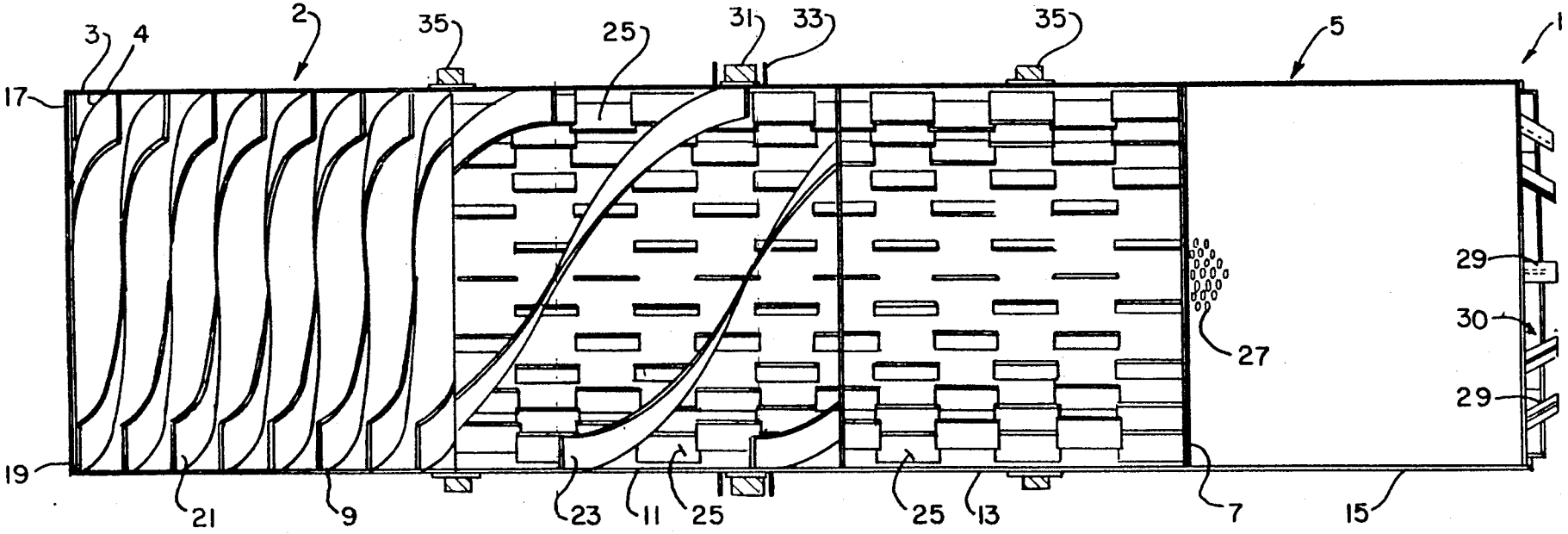
FIG. 1 is a cross-sectional view of a reclaiming drum of the present invention.

In the drawing, reference numeral 1 generally indicates a reclaiming drum of the present invention. The reclaiming drum 1 includes a cylinder 2, having an outer surface 3 and an inner surface 4, and a perforated portion formed by the cylinder 5. Cylinders 2 and 5 are connected by a flange 7. In the preferred embodiment, and by way of example, drum 1 is preferably 45' long and 12' in diameter. Perforate cylinder 5" is 10'4" in length. Drum 1 further comprises an inlet section 9, a first inner section 11, a second inner section 13, and the outlet section 15. Inlet section 9, and inner sections 11 and 13 are comprised of cylinder 2. Outlet section 15 is comprised of perforate cylinder 5.

Inlet section 9 comprises a header 17 attached to inner surface 4 of the drum 1 at its inlet 19 and a plurality of helically arranged vanes, or alternatively rifling means 21. Vane means 21 preferably have a width W of approximately 36" and are mounted to inner surface 4 on a 72" pitch starting every 90°. Vane means 21 operate to urge castings introduced into inlet section 9 forwardly through the section. As means 21 urge the castings forward, the castings tumble along the bottom of the drum and the easier to remove green sand separates from the castings.

First inner section 11 includes vane or rifling means 23 and a plurality of substantially horizontal, protruding plates or bar flights 25. Means 23 and plates 25 are mounted on inner surface 4 in any convenient manner, such as by welding. Rifling means 23 are preferably smaller than means 21, having a width of approximately only 24". Means 23 are mounted in section 11 at a 144" pitch, starting every 180°. Vane means 23 urges castings forwardly in the same manner as means 21. Plates or bar flights 25 are preferably 12"×24" in dimension, and are mounted to surface 4 in staggered rows starting every 22½ inches. The plates preferably overlap each other slightly. Plates 25 operate to agitate the castings by lifting them up and letting them fall. This agitation causes sand embedded in the surface of the castings to be jarred loose therefrom.

These plates or bar flights are shown mounted in alignment with the longitudinal axis of the shown drum. But, it is just as likely that they could be mounted upon a slight incline, to aid and assist in the urging of the casting along the media drum during its operation and usage.

Second inner section 13 also includes plates 25 to further agitate the castings. Section 13 contains no rifling means to urge the casting through the section. Because the plates are substantilly horizontal, or slightly inclined, the castings within section 13 move forward preferably by their own motion, or by being urged forward by castings behind them. Or, the drum itself may be slightly inclined downwardly to direct forward movement of the castings. Thus, the castings spend a longer time in the section 13, thereby providing for a greater period of agitation, effectively removing any confined sand.

Outlet section 15 includes a plurality of perforations along its surface to allow sand that has come loose of the castings to exit the drum separately from the casting. Section 15 further includes ejection means 29 at outlet 30 to aid the castings in existing the drum 1.

In one embodiment, as shown in the FIG., drum 1 may be used independently. In this preferred embodiment, drum 1 is mounted on a base as is shown and described in my prior patents, U.S. Pat. Nos. 3,998,262 and 4,674,691. To mount it on the base, drum 1 further includes a gear, such as a sprocket or pinion, as at 31 mounted on surface 4 which engages a drive device located on the base to rotate the drum. Gear 31 is partially enclosed by a cover 33. Guide bearings 35, which engage rollers on the base, are mounted on the surface 4 to provide stability to the drum.

In a second embodiment, drum 1 may be used as the inner cylinder of a dual sand reclaimer, or casting shake-out unit, such as in shown in my prior above mentioned patents. In such structure, drum 1 would not have the gear, gear cover, or bearing tracks mounted to its outer surface 4. Instead it would have a plurality of vanes to space the drum from the outer cylinder, as is shown in the aforementioned patents.

In operation, a casting having sand mold attached to it is introduced into inlet section 9 at inlet 19 while drum 1 is rotating. Riflin means or vanes 21 urge the castings forward through section 9 toward section 11. While being so urged, they tumble along the bottom of the drum, removing some of the loosely attached green sand. In section 11, plates 25 lift and drop the castings, greatly agitating them. This agitation causes the core and cling sand to separate from the mold more effectively. Rifling means 23 urges the castings through section 11 to section 13. In section 13, plates 25 further agitate the part to separate the sand from the casting. The great agitation caused by plates 25 in inner sections 11 and 13 jars loose the sand particles that are embedded in all surfaces of the casting, both inner and outer. Because there are no vane or rifling means in section 13, the casting spends greater time in this section and more of the sand is removed. This longer resident period coupled with the significant agitation tends to remove the mold sand more effectively than does the use of abrasive particles within the drum. It also eliminates the need to remove abrasive particles that may be caught up within the castings. Because the castings tumble, a majority of the sand caught within the castings will fall out of them.

In section 15, the sand that has come off the casting falls through perforations 27 to be reclaimed. The castings continue to tumble through outlet section 15 to be urged out outlet 30 by ejection means 29.

Variations or modifications to the subject matter of this invention may occur to those skilled in the art upon reviewing the disclosure herein. Such variations or modifications, if within the spirit of this invention, are intended to be encompassed within the scope of any claims to patent protection issuing hereon. For example, rifling means or vanes could be included in sections 13 and 15. Plates 25 could be mounted at an angle as aforesaid to the horizontal to urge the castings forwardly, so they will continue forward within the drum in a more regular fashion. The description of the preferred embodiment and the variations as set forth herein are done so for illustrative purposes only.

Having thus described the invention, what is claimed and desired to be securred by Letters Patent is:

1. A sand reclaiming drum for use in removal of clinging mold casting sand from a molded cast iron part, said reclaiming drum comprising a rotary drum including:

a. said rotary drum having various sections along its length, at least one of said sections including a series of plates mounted in rows on the inner surface of said drum, said plates in adjacent rows being staggered, each plate being approximately twelve inches in width and twenty-four inches in length, being mounted along one edge to the inner surface of said drum, said plates functioning to agitate the castings by lifting them up and letting them fall during operations of the reclaiming drum;

b. a final section of said rotary drum including a plurality of perforations through which said sand exits the drum as the castings are urged towards the outlet of said rotary drum; and c. a base for the reclaiming drum, and said drum being approximately horizontally mounted on said base, and driving means upon the base to provide rotation for the rotary drum during its operation.

2. The invention of claim 1 and wherein said drum is mounted on an incline upon said base.

3. The invention of claim 1 and wherein each plate overlaps the plates located within adjacent rows.

4. The invention of claim 3 and wherein said sand reclaiming drum includes a series of aligned sections, the first section of said drum comprising an inlet and incorporate a plurality of helically arranged rifling means to urge said casting forward, a second section for the drum comprising helically arranged rifling means to urge the castings forwardly and disposing said plates for agitating said castings to remove sand from castings by jarring of the same, a third section of the drum incorporating said plates for further agitation of said castings, and a fourth section of the drum comprising an outlet, and including said plurality of perforations through which the sand can exit said drum, and ejection means at the outlet of the drum and integrated into the fourth section to urge the castings forwardly of said drum when said castings exit therefrom.

5. The invention of claim 4 and wherein said rifling means of said second section are at a greater angle to the vertical than said rifling means of said first section.

6. The invention of claim 5, and wherein said drum forms an inner cylinder of a dual cylinder sand reclaimer.

* * * * *